US009981478B2

(12) United States Patent
Ikebe et al.

(10) Patent No.: US 9,981,478 B2
(45) Date of Patent: May 29, 2018

(54) LIQUID EJECTING DEVICE AND HEAD WITH FLEXIBLE MEMBER FOR SUPPLYING LIQUID FROM A MAIN TANK

(71) Applicant: CANON KABUSHIKI KAISHA, Tokyo (JP)

(72) Inventors: Norihiro Ikebe, Kawasaki (JP); Yasuo Kotaki, Yokohama (JP); Keiichiro Tsukuda, Yokohama (JP); Tatsuo Nanjo, Kawasaki (JP); Keisuke Iinuma, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/294,442

(22) Filed: Oct. 14, 2016

(65) Prior Publication Data

US 2017/0120613 A1 May 4, 2017

(30) Foreign Application Priority Data

Oct. 30, 2015 (JP) ..... 2015-214300

(51) Int. Cl.
*B41J 2/175* (2006.01)
*B41J 29/02* (2006.01)

(52) U.S. Cl.
CPC ..... *B41J 2/17553* (2013.01); *B41J 2/175* (2013.01); *B41J 2/17509* (2013.01); *B41J 2/17513* (2013.01); *B41J 2/17523* (2013.01); *B41J 29/02* (2013.01)

(58) Field of Classification Search
CPC .... B41J 2/17553; B41J 29/02; B41J 2/17523; B41J 2/17509; B41J 2/175; B41J 2/17513
See application file for complete search history.

(56) References Cited

U.S. PATENT DOCUMENTS

| | | | | |
|---|---|---|---|---|
| 5,425,478 | A | 6/1995 | Kotaki et al. | 222/501 |
| 5,430,471 | A | 7/1995 | Nakajima et al. | 347/87 |
| 5,504,511 | A | 4/1996 | Nakajima et al. | 347/86 |
| 5,567,373 | A | 10/1996 | Sato et al. | 264/112 |
| 5,583,549 | A | 12/1996 | Ujita et al. | 347/86 |

(Continued)

FOREIGN PATENT DOCUMENTS

| | | |
|---|---|---|
| JP | 2000-246911 | 9/2000 |
| JP | 2007-105883 | 4/2007 |

OTHER PUBLICATIONS

U.S. Appl. No. 15/294,406, filed Oct. 14, 2016.

(Continued)

*Primary Examiner* — Henok Legesse
(74) *Attorney, Agent, or Firm* — Fitzpatrick, Cella, Harper & Scinto

(57) ABSTRACT

A downsized liquid ejecting device is provided. To do so, the liquid ejecting device includes a liquid container, a head provided on a carriage and having a liquid containing unit capable of storing liquid thereinside, and a liquid ejecting unit ejecting liquid, and a flexible member that connects between the liquid container and the liquid containing unit and supplies the liquid stored inside the liquid container to the liquid containing unit, and a concave portion is formed on an outer wall surface of the liquid containing unit, and a projected portion that is inserted to the flexible member is formed inside the concave portion.

20 Claims, 12 Drawing Sheets

(56) References Cited

U.S. PATENT DOCUMENTS

| | | | | |
|---|---|---|---|---|
| 5,589,862 | A | 12/1996 | Ujita et al. | 347/87 |
| 5,604,523 | A | 2/1997 | Tsukuda et al. | 347/86 |
| 5,608,437 | A | 3/1997 | Iwata et al. | 347/86 |
| 5,619,237 | A | 4/1997 | Inoue et al. | 347/86 |
| 5,619,239 | A | 4/1997 | Kotaki et al. | 347/86 |
| 5,742,310 | A | 4/1998 | Kotaki | 347/86 |
| 5,781,213 | A | 7/1998 | Ujita et al. | 347/86 |
| 5,784,088 | A | 7/1998 | Ujita et al. | 347/86 |
| 5,805,188 | A | 9/1998 | Nakajima et al. | 347/87 |
| 5,815,184 | A | 9/1998 | Ujita et al. | 347/87 |
| 5,852,457 | A | 12/1998 | Kotaki et al. | 347/86 |
| 5,900,889 | A | 5/1999 | Tsukuda | 347/23 |
| 5,929,885 | A | 7/1999 | Nakajima et al. | 347/87 |
| 5,988,804 | A | 11/1999 | Kotaki et al. | 347/87 |
| 6,070,974 | A | 6/2000 | Kotaki et al. | 347/86 |
| 6,102,533 | A | 8/2000 | Nozawa et al. | 347/86 |
| 6,116,722 | A | 9/2000 | Sato et al. | 347/85 |
| 6,145,975 | A | 11/2000 | Kotaki et al. | 347/87 |
| 6,152,555 | A | 11/2000 | Nozawa et al. | 347/49 |
| 6,170,939 | B1 | 1/2001 | Ujita et al. | 347/86 |
| 6,234,615 | B1 | 5/2001 | Tsukuda | 347/85 |
| 6,243,116 | B1 | 6/2001 | Kotaki et al. | 347/86 |
| 6,264,315 | B1 | 7/2001 | Nozawa et al. | 347/86 |
| 6,336,709 | B1 | 1/2002 | Inoue et al. | 347/49 |
| 6,338,546 | B1 | 1/2002 | Kotaki et al. | 347/49 |
| 6,361,158 | B1 | 3/2002 | Inoue et al. | 347/86 |
| 6,390,612 | B1 | 5/2002 | Kotaki et al. | 347/85 |
| 6,402,298 | B1 | 6/2002 | Nanjo et al. | 347/49 |
| 6,409,322 | B1 * | 6/2002 | Ishitsu | B41J 2/175 347/85 |
| 6,419,350 | B1 | 7/2002 | Abe et al. | 347/86 |
| 6,421,623 | B1 | 7/2002 | Furukawa et al. | 702/100 |
| 6,454,399 | B2 | 9/2002 | Ujita et al. | 347/86 |
| 6,565,199 | B2 | 5/2003 | Ujita et al. | 347/86 |
| 6,623,104 | B1 | 9/2003 | Kotaki et al. | 347/49 |
| 6,702,427 | B2 | 3/2004 | Shimizu et al. | 347/50 |
| 6,712,458 | B2 | 3/2004 | Hatasa et al. | 347/86 |
| 6,719,416 | B2 | 4/2004 | Anma et al. | 347/86 |
| 6,742,881 | B2 | 6/2004 | Kotaki et al. | 347/86 |
| 6,783,220 | B2 | 8/2004 | Ujita et al. | 347/87 |
| 6,815,381 | B1 | 11/2004 | Yamamoto et al. | 442/187 |
| 6,824,258 | B2 | 11/2004 | Yamamoto et al. | 347/86 |
| 6,827,431 | B2 | 12/2004 | Kitabatake et al. | 347/86 |
| 6,869,158 | B2 | 3/2005 | Kojima et al. | 347/19 |
| 6,877,847 | B2 | 4/2005 | Hayashi et al. | 347/86 |
| 6,916,085 | B2 | 7/2005 | Kotaki et al. | 347/49 |
| 6,942,325 | B2 | 9/2005 | Nanjo | 347/86 |
| 6,942,326 | B2 | 9/2005 | Hayashi et al. | 347/86 |
| 6,966,631 | B2 | 11/2005 | Matsuo et al. | 347/49 |
| 6,971,741 | B2 | 12/2005 | Nanjo et al. | 347/85 |
| 7,077,514 | B2 | 7/2006 | Inoue et al. | 347/86 |
| 7,104,640 | B2 | 9/2006 | Ogura et al. | 347/86 |
| 7,111,931 | B2 | 9/2006 | Amma et al. | 347/86 |
| 7,118,194 | B2 | 10/2006 | Matsuo et al. | 347/49 |
| 7,125,109 | B2 | 10/2006 | Watanabe et al. | 347/86 |
| 7,134,747 | B2 | 11/2006 | Hayashi et al. | 347/86 |
| 7,165,829 | B2 | 1/2007 | Hayashi et al. | 347/49 |
| 7,207,159 | B2 | 4/2007 | Nanjo et al. | 53/492 |
| 7,293,865 | B2 | 11/2007 | Tsukuda et al. | 347/86 |
| 7,303,090 | B2 | 12/2007 | Nanjo et al. | 220/360 |
| 7,350,910 | B2 | 4/2008 | Amma et al. | 347/86 |
| 7,384,116 | B2 | 6/2008 | Kotaki et al. | 347/19 |
| 7,384,129 | B2 | 6/2008 | Nagata et al. | 347/43 |
| 7,396,118 | B2 | 7/2008 | Ogawa et al. | 347/87 |
| 7,401,909 | B2 | 7/2008 | Inoue et al. | 347/86 |
| 7,407,274 | B2 | 8/2008 | Inoue et al. | 347/86 |
| 7,407,275 | B2 | 8/2008 | Inoue et al. | 347/86 |
| 7,552,837 | B2 | 6/2009 | Nanjo et al. | 220/360 |
| 7,735,984 | B2 | 6/2010 | Iijima et al. | 347/86 |
| 7,914,137 | B2 | 3/2011 | Inoue et al. | 347/86 |
| 7,926,927 | B2 | 4/2011 | Kotaki et al. | 347/86 |
| 7,950,790 | B2 | 5/2011 | Kubo et al. | 347/86 |
| 8,020,978 | B2 | 9/2011 | Ogawa et al. | 347/86 |
| 8,047,641 | B2 | 11/2011 | Nanjo et al. | 347/86 |
| 8,109,617 | B2 | 2/2012 | Kotaki et al. | 347/86 |
| 8,136,930 | B2 | 3/2012 | Anma et al. | 347/86 |
| 8,205,974 | B2 | 6/2012 | Ogura et al. | 347/86 |
| 8,313,185 | B2 | 11/2012 | Hatasa et al. | 347/92 |
| 8,322,807 | B2 | 12/2012 | Seki et al. | 347/6 |
| 8,425,022 | B2 | 4/2013 | Inoue et al. | 347/86 |
| 8,469,498 | B2 | 6/2013 | Ohashi et al. | 347/86 |
| 8,529,037 | B2 | 9/2013 | Miyashita et al. | 347/86 |
| 8,550,607 | B2 | 10/2013 | Inoue et al. | 347/86 |
| 8,770,730 | B2 | 7/2014 | Nanjo et al. | 347/86 |
| 8,770,731 | B2 | 7/2014 | Miyashita et al. | 347/86 |
| 8,960,869 | B2 | 2/2015 | Takada et al. | 347/86 |
| 9,016,842 | B2 | 4/2015 | Miyashita et al. | 347/86 |
| 9,333,758 | B2 | 5/2016 | Koshikawa et al. | B41J 2/17556 |
| 9,375,938 | B2 | 6/2016 | Kondo et al. | B41J 2/17513 |
| 2004/0246304 | A1 | 12/2004 | Takahashi et al. | 347/49 |
| 2005/0007420 | A1 | 1/2005 | Ogawa et al. | 347/50 |
| 2006/0274131 | A1 | 12/2006 | Noguchi et al. | 347/85 |
| 2013/0050310 | A1 | 2/2013 | Seki et al. | 347/6 |
| 2015/0343793 | A1 | 12/2015 | Takada et al. | B41J 2/17556 |
| 2016/0200113 | A1 | 7/2016 | Nanjo et al. | B41J 2/175 |
| 2016/0200114 | A1 | 7/2016 | Nanjo et al. | B41J 2/17553 |

OTHER PUBLICATIONS

U.S. Appl. No. 15/296,876, filed Oct. 18, 2016.
U.S. Appl. No. 15/272,026, filed Sep. 21, 2016.
U.S. Appl. No. 15/288,879, filed Oct. 7, 2016.
U.S. Appl. No. 15/274,806, filed Sep. 23, 2016.

* cited by examiner

LIQUID EJECTING DEVICE AND HEAD WITH FLEXIBLE MEMBER FOR SUPPLYING LIQUID FROM A MAIN TANK

BACKGROUND OF THE INVENTION

Field of the Invention

The present invention relates to a liquid ejecting device and a head.

Description of the Related Art

As a liquid ejecting device (e.g., ink-jet printing device) for ejecting liquid such as ink to print an image or character, for example, there is one having a form in which a head having an ink tank is mounted on a carriage and a main tank for storing ink is placed at another position from the carriage. The ink in the main tank is supplied to the ink tank on the head side with a tube or the like, and the ink is ejected from an ejecting unit.

As the liquid ejecting device in such a form, Japanese Patent Laid-Open No. 2007-105883 discloses the one having a configuration in which a supply needle is attached to a cover member of an ink tank so as to pierce the cover member. With the configuration, a connecting member is attached around the supply needle for connection to the tube. Further, a connecting member is attached to one end of the tube for connection to the connecting member attached to the cover member of the ink tank. The connecting member of the ink tank on the side of the cover member is connected to the connecting member on the side of the tube, and thereby the tube is connected to the ink tank.

SUMMARY OF THE INVENTION

A liquid ejecting device of the present invention includes: a liquid container that can store liquid thereinside; a head provided on a carriage and including a liquid containing unit that can store liquid thereinside, and a liquid ejecting unit that ejects liquid; and a flexible member that connects the liquid container to the liquid containing unit and supplies the liquid stored inside the liquid container to the liquid containing unit, and a concave portion that is concave in a direction to an inside of the liquid containing unit is formed on an outer wall surface of the liquid containing unit, and a projected portion that is projected in a direction to an outside of the liquid containing unit from a bottom surface of the concave portion and is inserted to the flexible member is formed inside the concave portion.

Further features of the present invention will become apparent from the following description of exemplary embodiments (with reference to the attached drawings).

DESCRIPTION OF THE EMBODIMENTS

With the liquid ejecting device disclosed in Japanese Patent Laid-Open No. 2007-105883, a connecting member on the side of the ink tank attached to a wall surface of a cover member of the ink tank on the side of a top surface is connected to a connecting member on the side of the tube, and thereby the ink tank is connected to the tube. Therefore, a connecting unit for connection between the ink tank and the tube is arranged on the top surface side of the cover member of the ink tank. Thus, in the ink tank, the connecting unit is projected to the outer side than the cover member of the ink tank, the configuration of the ink tank including the connecting unit to the tube is increased in size, and the configuration of the liquid ejecting device may be increased in size, as a result.

According to the present invention, there is provided a downsized liquid ejecting device in consideration of the situations.

Hereinbelow, a description is given of embodiments of the present invention with reference to the drawings.

Figure 1:
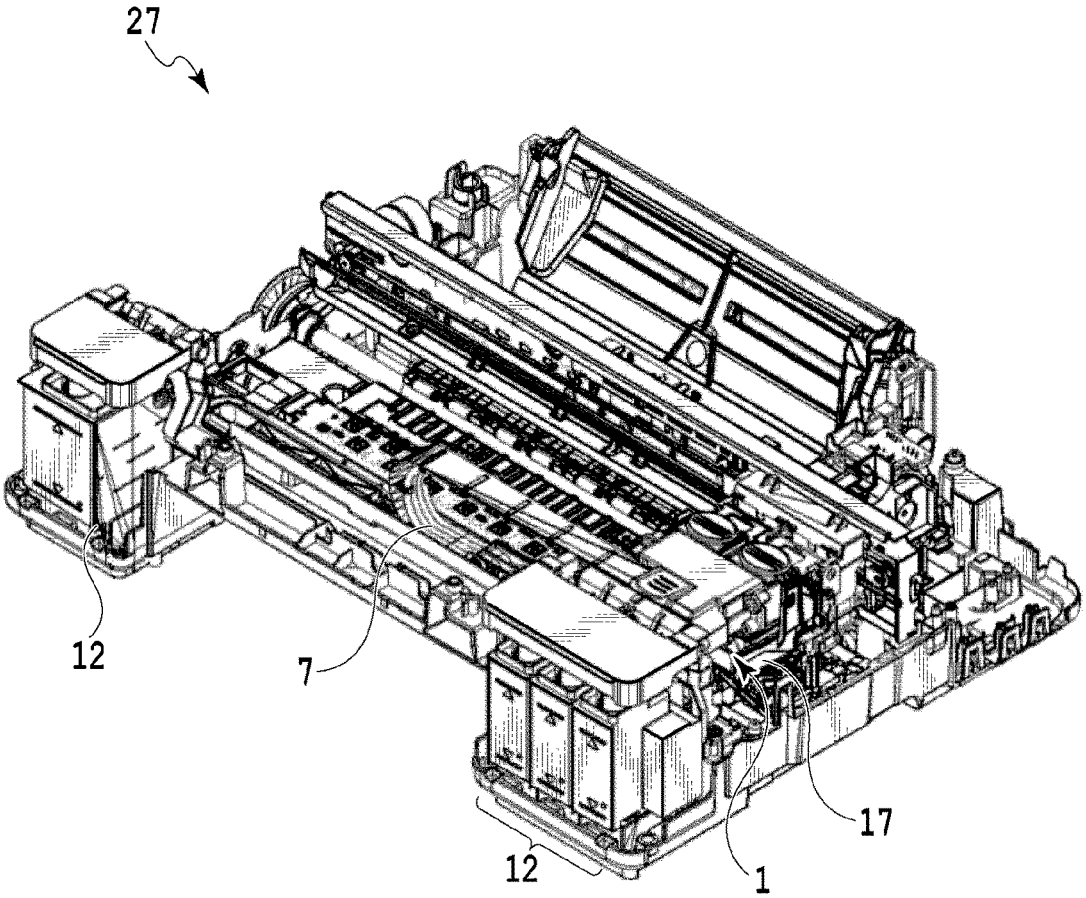
FIG. 1 is a perspective view of a liquid ejecting device in a state in which its exterior is detached.

FIG. 1 shows a perspective view of a state in which an exterior of a liquid ejecting device (ink-jet printing device) 27 of the present invention is detached. A head 1 is configured capable of being mounted on a carriage 17, and is provided on the carriage 17 by being connected to a joint (not shown) provided on the top portion of the carriage. The liquid ejecting device 27 is a serial-scanning-style printing device, and the carriage (supporting member) 17 is movably guided in the main scanning direction by a guide shaft. The carriage 17 reciprocates in the main scanning direction with a carriage motor and a driving force transmitting mechanism such as a belt that transmits its driving force. The carriage 17 mounts the head 1.

Figure 2:
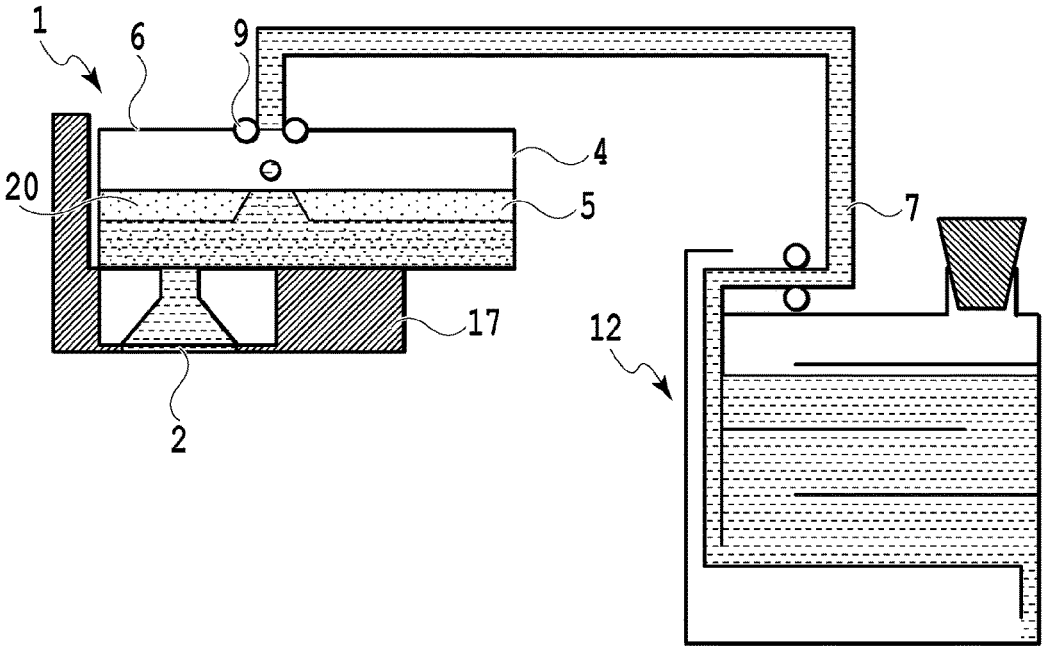
FIG. 2 is a cross-sectional view showing a liquid supply system of a liquid ejecting device in FIG. 1.

FIG. 2 is a schematic cross-sectional view of the head 1 and a liquid flow passage formed inside the head 1 in the liquid ejecting device 27 in which the head 1 is mounted. In the liquid ejecting device 27, a liquid container (main tank) that can store a relatively large amount of liquid thereinside is placed outside the carriage 17. The liquid container 12 is arranged at a position different from on the carriage 17, apart from the carriage 17. The liquid container 12 is connected to the liquid containing unit of the head 1 provided on the carriage 17 by a flexible member 7 such as a tube.

The head 1 mounted on the carriage 17 includes a liquid ejecting unit (ink ejecting unit) 2 that ejects the liquid and a liquid containing unit (ink tank unit) 20 that supplies the liquid (ink) to the liquid ejecting unit 2. The liquid ejecting unit 2 is integrated to the liquid containing unit 20. As mentioned above, the carriage 17 is configured capable of supporting the head 1. The liquid containing unit 20 in the head 1 is configured capable of storing the liquid thereinside.

Note that the liquid containing unit and the liquid ejecting unit may not be integrated but may be formed separately. A printing medium such as a sheet is conveyed in a sub-scanning direction perpendicular to the main scanning direction of the carriage by a conveyance roller. The liquid ejecting device 27 repeats a printing operation for ejecting the liquid to a print area of the printing medium on a platen while moving the liquid ejecting unit 2 in the main scanning direction and a conveying operation for conveying the printing medium in the sub-scanning direction by a distance corresponding to a printing width thereof. Thus, images are sequentially printed (formed) on the printing medium.

A plurality of ejecting ports, a plurality of pressure chambers communicating with the plurality of ejecting ports, and a plurality of flow passages communicating with the pressure chambers are formed, respectively, in the liquid ejecting unit 2 of the head 1. The liquid is supplied via the respective flow passages to the pressure chambers formed inside the liquid ejecting unit 2 from the liquid containing unit of the head 1. Each pressure chamber includes, e.g., a heat generating element (electricity/heat converter) as an energy generating element. The heat generating element is energized via a wiring, and thermal energy is generated from the heat generating element, thereby heating the ink in the pressure chamber and generating bubbles with film boiling. Liquid droplets are ejected from the ejecting port with bubble generating energy at this time. Note that a piezoelectric element or the like may be used as an energy generating element.

The carriage 17 moves in the main scanning direction, and thereby the liquid is ejected from the liquid ejecting unit 2 while the head 1 moves. The ejected liquid lands onto the printing medium or the like, thereby performing the printing. In the printing, the liquid contained in the liquid container 12 is supplied to the liquid containing unit 20 of the head 1 via the flexible member 7. The liquid is directly stored in the liquid container 12. In order to increase a storage amount of the liquid, preferably, a holding member to hold the liquid, such as a sponge, is not arranged inside the liquid container 12. As mentioned above, the liquid in the liquid container 12 is continuously supplied to the liquid containing unit 20 of the head 1.

The liquid ejecting unit 2 of the head 1 is arranged at a position higher in the gravity direction than a portion where the liquid is stored in the liquid container 12. Therefore, a water head difference is generated between the liquid ejecting unit 2 and the liquid container 12 in the head 1. With the water head difference, a negative pressure is generated inside the liquid ejecting unit 2 of the head 1. The generation of the negative pressure in the liquid ejecting unit 2 prevents the drop of the liquid from the ejecting port of the liquid ejecting unit 2, thereby holding the liquid inside the liquid ejecting unit 2. Note that the present invention is not limited to the configuration of the head 1 in this form and the liquid container 12 and can be applied to a system with a negative pressure generating mechanism in the liquid container 12.

Figure 3:
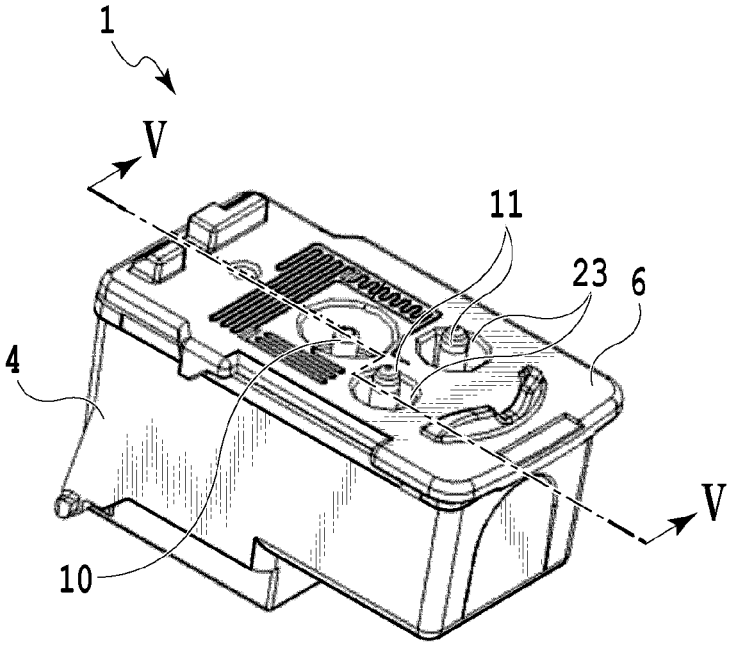
FIG. 3 is a perspective view of a head mounted in the liquid ejecting device in FIG. 1.
Figure 4:
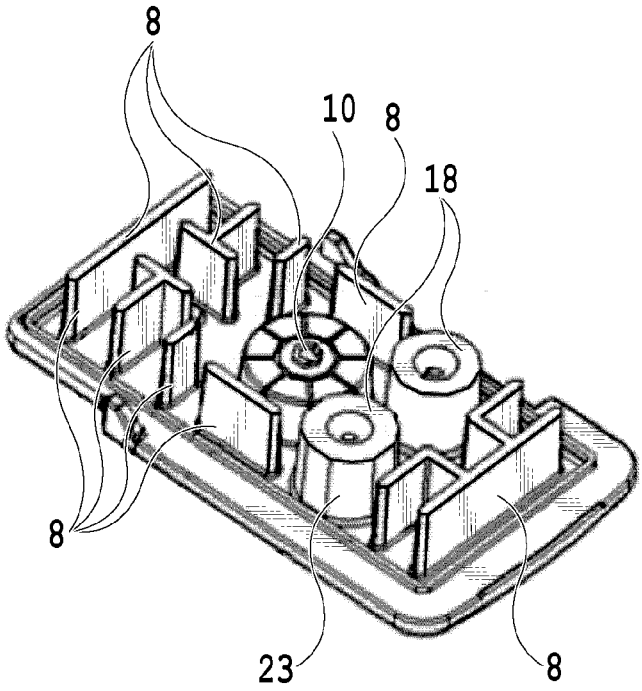
FIG. 4 is a perspective view of a cover member of the head in FIG. 3.

FIG. 3 is a perspective view for explaining the configuration of the head 1, showing a configuration of a form for mounting one-color liquid (ink) in one head. FIG. 4 is a perspective view of a cover member 6 in the head 1 in FIG. 3, seen with a surface directed to the inside of the head 1 upward.

The head 1 is formed by welding the cover member 6 to a case 4. A flow passage connecting member 13 (see FIG. 6) is attached to a position for connection to the cover member 6 in the flexible member 7. A projected portion 11 as a portion for connecting the flexible member 7 to the flow passage connecting member 13 and a liquid supply unit 10 are formed on an outer wall surface of the cover member 6. Moreover, as shown in FIG. 3, a concave portion 23 that is concave in a direction to the inside of the liquid containing unit is formed on a surface forming the cover member 6 as the outer wall surface of the liquid containing unit. A pin-shaped projected portion 11 is formed to be projected in a direction to the outside of the liquid containing unit from a bottom surface 18 of the concave portion. Note that the outer wall surface does not mean only a surface exposed to the outside and may form an outer surface of the liquid containing unit. Further, in the case where the outside of the portion containing the liquid is surrounded by a member, for example, a portion including the member can be regarded as the liquid containing unit.

Figure 5:
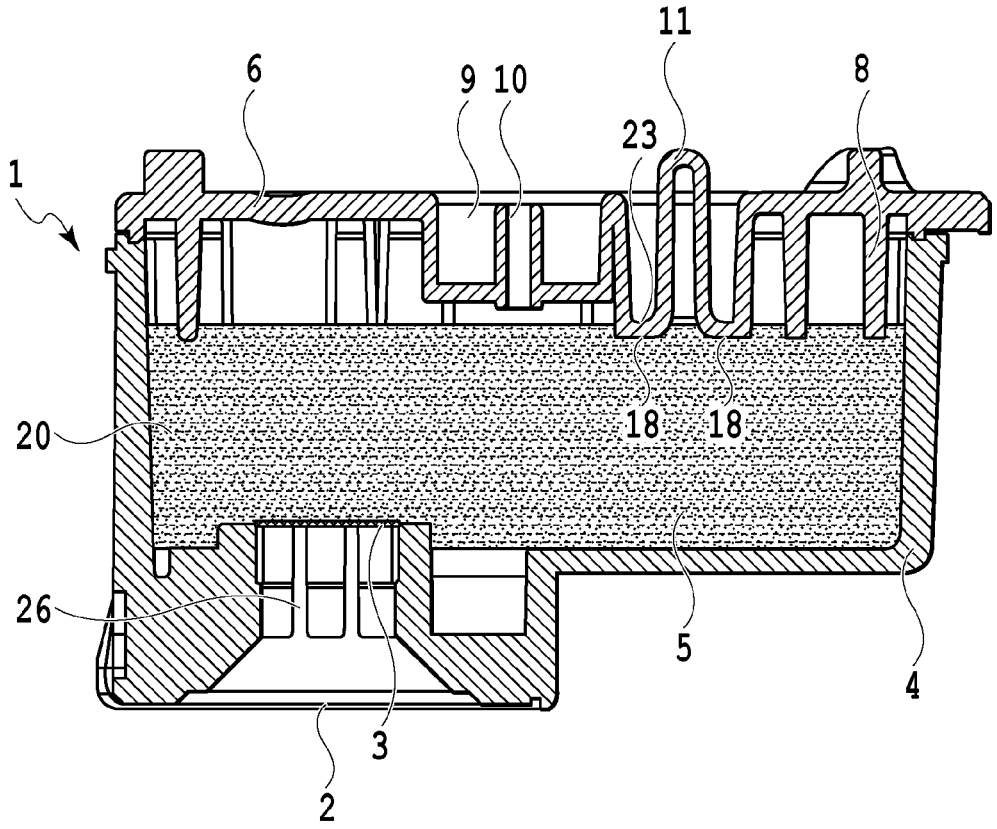
FIG. 5 is a cross-sectional view of the head in FIG. 3 along a line V-V.

FIG. 5 shows a cross-sectional view of the head 1 in FIG. 3 along a line V-V. A holding member 5 is enclosed inside the liquid containing unit 20 to hold the liquid stored inside the liquid containing unit 20. Examples of the holding member 5 include a fiber absorber. On an outer wall surface of the cover member 6, the concave portion (first concave portion) 23 that is concave in a direction (direction from the cover member 6 to the holding member 5) to the inside of the liquid containing unit is formed in an outer circumference of the projected portion 11.

The projected portion 11 that is projected from the central position of the bottom surface of the concave portion 23 in a direction (direction to the flow passage connecting member 13) to the outside of the liquid containing unit 20 is formed. In the case where the flexible member 7 is connected to the cover member 6, the projected portion 11 is inserted into an inserting port 16 formed in the flexible member 7. As mentioned above, positioning is performed between the flexible member 7 and the cover member 6. Referring to FIGS. 3 and 4, two projected portions 11 are formed on one cover member 6.

As mentioned above, the holding member 5 that can hold the stored liquid is enclosed inside the liquid containing unit 20 in the head 1. Further, the liquid ejecting unit 2 that ejects the liquid is arranged in the head 1. As shown in FIG. 5, the head 1 has a flow passage 26 formed to guide the liquid stored in the liquid containing unit 20 to the liquid ejecting unit 2. A filter 3 that removes a foreign matter such as dust included in the liquid is attached to the flow passage 26 between the liquid containing unit 20 and the liquid ejecting unit 2 to suppress the flow-in of the foreign matter to the liquid ejecting unit 2.

In order to efficiently supply the liquid held by the holding member 5 to the liquid ejecting unit 2, it is required that the holding member 5 is press-contacted with the filter 3. For that purpose, a rib 8 that presses the holding member 5 is provided on a rear surface of the cover member 6. With the cover member 6 configured as mentioned above, the rib 8 presses the holding member 5 in a direction to the flow passage 26 in the case where the cover member 6 is welded to the case 4. That is, the rib 8 presses the holding member 5 in the direction to the filter 3. As a consequence, the holding member 5 and the filter 3 are press-contacted with each other, and the holding member 5 and the filter 3 are arranged in the liquid containing unit 20 of the head 1.

In a state in which the cover member 6 is attached to the case 4, the concave portion 23 on the outer wall surface (outer wall surface of the cover member) of the liquid containing unit is concave to a position where the concave portion 23 comes into contact with the holding member 5. Therefore, in the case where the cover member 6 is attached to the case 4, the holding member 5 is pressed to the inside by the bottom surface 18 of the concave portion 23.

The liquid supply unit 10 is formed in the cover member 6 to supply the liquid supplied from the flexible member 7 to the inside of the liquid containing unit 20. The liquid supply unit 10 is a hollow flow passage that guides the liquid supplied from the flexible member 7 into the liquid containing unit 20. In a state in which the flexible member 7 is not connected to the head 1, the inside of the liquid containing unit 20 communicates with the outside thereof in the liquid supply unit 10. Therefore, in a state in which the flexible member 7 is not connected to the head 1, in order to suppress the leakage of the liquid from the head 1, the liquid supply unit 10 is configured not to be touched to the holding member 5. As a consequence, the flow passage from the holding member 5 is shut off, thereby suppressing the leakage of the liquid to the outside of the head 1.

As mentioned above, in the cover member 6, the projected portion 11 is formed to perform positioning between the cover member 6 and the flow passage connecting member 13 attached to the flexible member 7. Further a positioning port (inserting port) to which the projected portion 11 is inserted is formed in the flow passage connecting member 13 of the flexible member 7. The projected portion 11 is projected in a direction (direction to the flow passage connecting member 13) to the outside of the liquid containing unit so as to be inserted to the positioning port 16 formed in the flow passage connecting member 13. The projecting direction of the projected portion 11 is an upward direction in the gravity direction from the cover member 6 in a posture of the head 1 in the case where the liquid ejecting device 27 is used, and corresponds to a direction of the flow passage connection between the flow passage connecting member 13 and the liquid containing unit 20. In the case where the flow passage connecting member 13 is attached to the cover member 6, the projected portion 11 is inserted to the positioning port 16, and thereby the liquid supply unit 10 of the cover member 6 and a flow-passage-connecting-member flow passage (first liquid flow passage) 22 of the flow passage connecting member 13 are arranged at a corresponding position. Therefore, proper positioning is performed between the flow passage connecting member 13 and the cover member 6.

Figure 6:
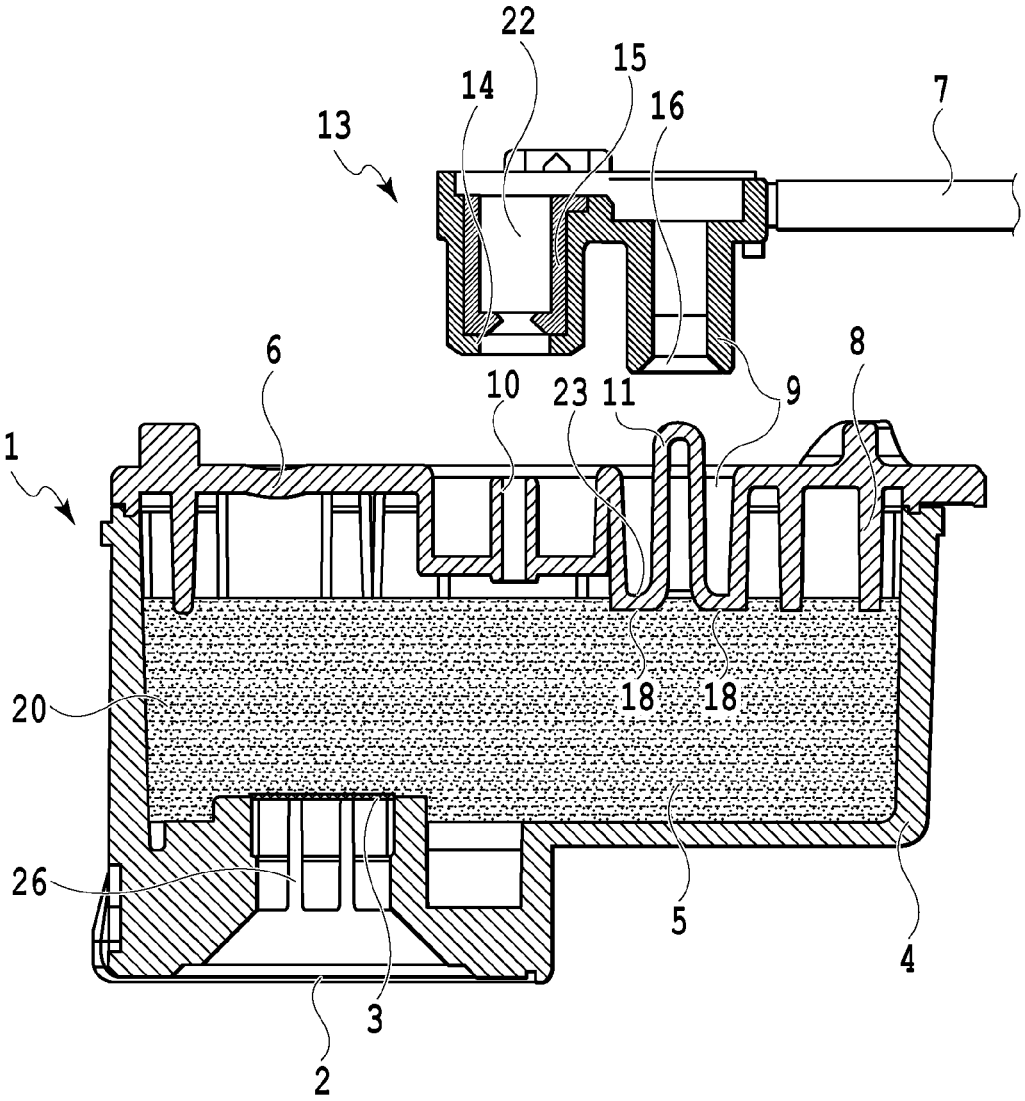
FIG. 6 is a cross-sectional view showing the head in FIG. 5 and a flow passage connecting member of a flexible member connected to the head.

FIG. 6 is a cross-sectional view of the head 1, the flexible member 7, and the flow passage connecting member 13 for connecting the head 1 and the flexible member 7. On a wall surface of the inside of a flow passage that communicates with the liquid supply unit 10 of the cover member 6 in the flow passage connecting member 13, an elastic member 15 is arranged. The liquid supply unit 10 is inserted inside the elastic member 15. Therefore, the liquid supply unit 10 is fit into the inside of the elastic member 15, thereby attaching the flow passage connecting member 13 to the cover member 6. Further, the liquid supply unit 10 formed in the cover member 6 is inserted inside the elastic member 15 in the flow passage connecting member 13, and thereby a flow passage communicates between the flexible member 7 and the head 1. A flow-passage-connecting-member flow passage 22 is formed in the flow passage connecting member 13 in the flexible member 7 to guide the liquid to the liquid supply unit 10. The elastic member 15 is arranged inside the flow-passage-connecting-member flow passage 22. The projected portion 11 is inserted into the positioning port 16, and thus the liquid supply unit 10 and the flow-passage-connecting-member flow passage 22 are arranged at corresponding positions, respectively.

In the head 1, the projected portion 11 is formed inside the concave portion 23. Therefore, the projected portion 11 is projected from a position (bottom surface of the concave portion) located deep inside from the top surface of the cover member 6 in the head 1 in a direction (direction to the flow passage connecting member 13) to the outside of the liquid containing unit. As a consequence, while sufficiently ensuring a length of stroke for positioning with the projected portion 11, it is possible to reduce an amount of projection to the outside from the top surface of the cover member 6 in the projected portion 11. That is, it is possible to reduce the size of a projected portion in a direction to the flow passage connecting member 13 from the cover member 6.

Since it is possible to reduce the amount of projection in the direction to the flow passage connecting member 13 in the projected portion 11, in a posture in which the head 1 is mounted on the carriage 17, the height of the head 1 thus can be reduced. Therefore, while sufficiently ensuring a length of stroke of the projected portion 11 that is required for positioning between the cover member 6 and the flow passage connecting member 13, it is possible to reduce the sizes of the head 1 and the liquid ejecting device having the head 1. Furthermore, since the length of stroke for positioning with the projected portion 11 is sufficiently ensured, it is possible to precisely perform positioning between the flow passage connecting member 13 and the cover member 6.

The whole projected portion 11 is preferably in the concave portion 23 in consideration of only reduction in size. That is, an end of the projected portion 11 extending from the bottom surface of the concave portion 23 is at the same height as that of a top surface (top surface of an outer wall surface of the cover member) of the outer wall surface of the liquid containing unit or at a lower position, preferably, the end thereof is not projected from the top surface. However, in consideration of insertion to the flexible member 7, the end of the projected portion 11 is preferably at a higher position than the top surface (top surface of the outer wall surface of the cover member) of the outer wall surface of the liquid containing unit, as shown in FIGS. 5 and 6. However, in the case where the amount of projection from the top surface is too large, it is difficult to accomplish the reduction in sizes of the head and the liquid ejecting device. In consideration of this point, the projected portion 11 preferably has a height projected from the top surface (or the concave portion 23) of the outer wall surface of the liquid containing unit, the height being 20% or more and 70% or less of a height of the projected portion in the concave portion. More preferably, the height is 30% or more and 50% or less.

Further, since the concave portion 23 is formed on the outer wall surface of the cover member 6, the cover member 6 is bent. Therefore, regarding the height direction of the head 1, the position of the bottom surface 18 of the concave portion 23 can be deviated from the position of another surface of the cover member 6. Even in the case where impact of drop or vibration is applied to the head 1, directly operating to the projected portion 11 is suppressed, which makes it hard to deform the projected portion 11.

Note that, in the embodiment, a description is given of a form for enclosing the liquid of one kind (one color) to the liquid containing unit 20 in the head 1. However, the present invention is not limited to this. The number of kinds (e.g., colors) of the liquid contained in the liquid containing unit 20 may be two or more. In this case, a plurality of liquid ejecting units 2 may be formed in the head 1, corresponding to a plurality of kinds of the liquid.

Figure 7A:
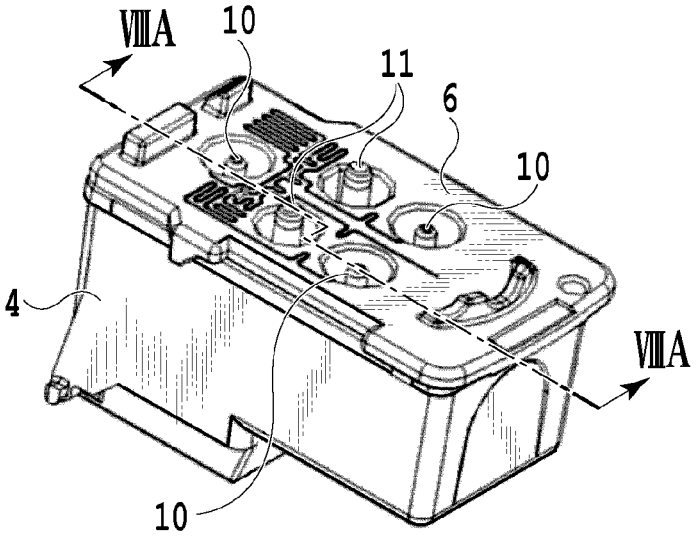
FIG. 7A is a perspective view showing a modified example of the head in FIG. 3.
Figure 7B:
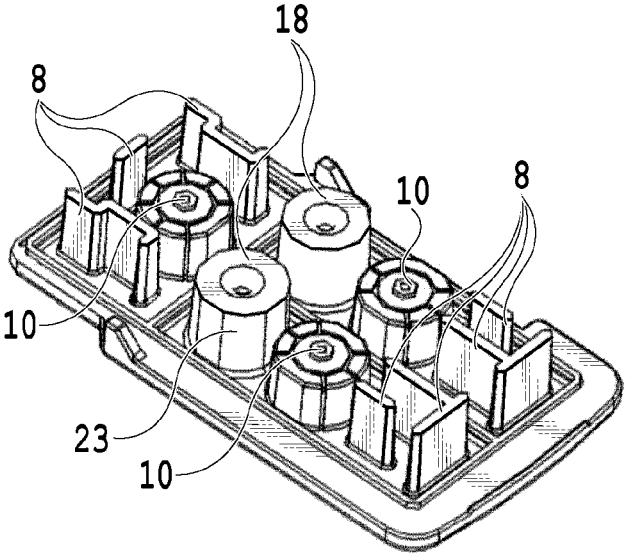
FIG. 7B is a perspective view of the cover member of the head.

FIG. 7A shows a perspective view of the head in a form for containing the liquid with three kinds of colors in the liquid containing unit 20. FIG. 7B shows a perspective view of the cover member 6 used for the head in FIG. 7A. In the head shown in FIGS. 7A and 7B, three liquid containing units are formed. The respective liquid containing units are divided by partitions, thereby forming three liquid containing units in one head. Corresponding to three kinds of the liquid, three liquid supply units 10 are formed in the cover member 6. The liquid supply units 10 are individually formed, corresponding to the respective liquid containing units 20. Further, as shown in FIG. 7A, two projected portions 11 are formed in the head 1.

Figure 8A:
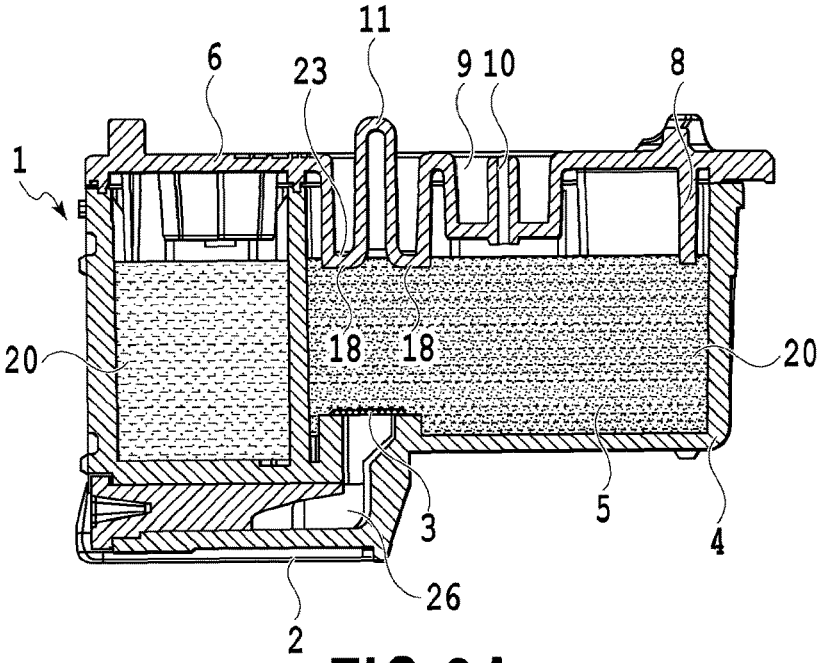
FIG. 8A is a cross-sectional view of the head in FIG. 7A along a line VIIIA-VIIIA.
Figure 8B:
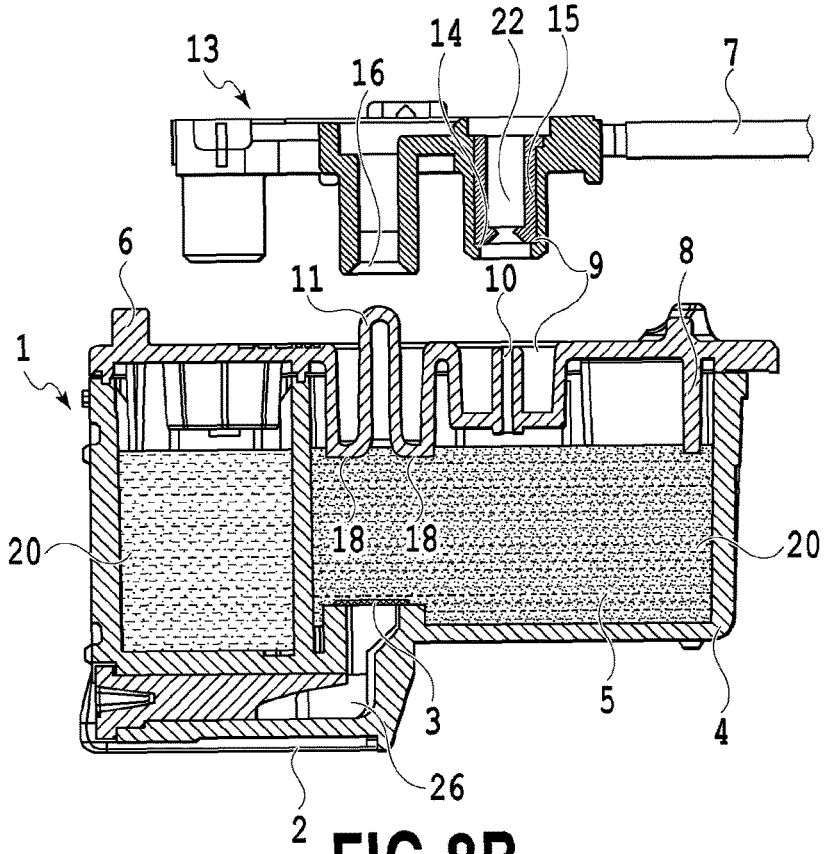
FIG. 8B is a cross-sectional view showing a flow passage connecting member of the flexible member connected to the head.

FIG. 8A shows a cross-sectional view of the head 1 along the line VIIIA-VIIIA in FIG. 7A. Further, FIG. 8B shows a cross-sectional view of the head 1 and the flow passage connecting member 13 in the case where the flow passage connecting member 13 is connected to the head 1 shown in FIG. 8A. Three elastic members 15 are formed in the flow passage connecting member 13 that is attached to the flexible member 7, corresponding to three liquid supply units 10 formed in the cover member 6 of the head 1. Furthermore, the three elastic members 15 are arranged inside the three flow-passage-connecting-member flow passages 22. In addition, two positioning ports 16 are formed in the flow passage connecting member 13, corresponding to the two projected portions 11 formed in the cover member 6 in the head 1. In the case where the flow passage connecting member 13 is attached to the cover member 6, the respective projected portions 11 are inserted to the corresponding positioning ports 16, thereby performing the positioning between the flow passage connecting member 13 and the cover member 6.

Preferably, in the head 1, a position where a flow passage (second liquid flow passage) 26 through which the liquid is supplied to the liquid ejecting unit 2 from the liquid containing unit 20 is formed is a position facing the concave portion 23. That is, preferably, the filter 3 arranged on the flow passage 26 is just below the concave portion 23 and at a position downward in the gravity direction of the concave portion 23. Note that the position just below the concave portion 23 means a position where the liquid containing unit 20 is partially overlapped with at least the concave portion 23, in the case where the liquid containing unit 20 is seen from above.

Figure 9:
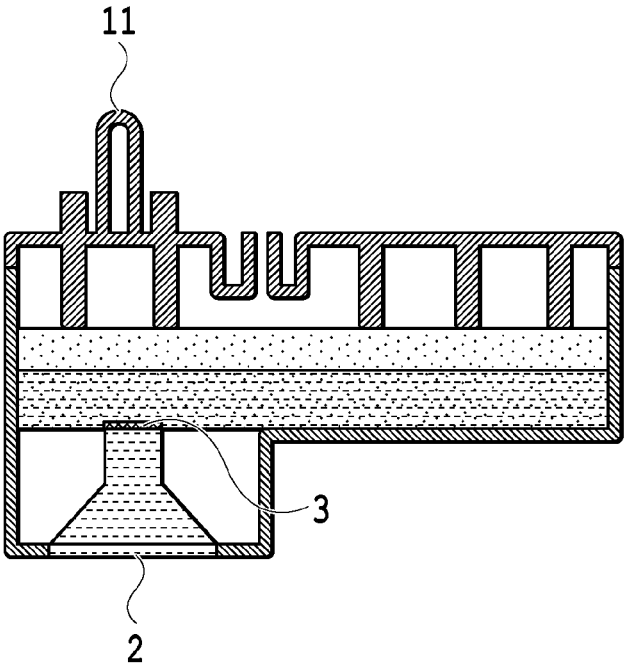
FIG. 9 is a cross-sectional view of the head.

Next, a description is given of a head as a comparative example with reference to FIG. 9. In the head shown in FIG. 9, the projected portion 11 is formed on the outer wall surface (above the top surface) of the cover member 6 in the head. In the case where the projected portion 11 is provided on the top surface of the cover member 6 of the cartridge to perform positioning with the flow passage connecting member 13, as shown in FIG. 9, the height of the head is increased corresponding to the projected portion 11, and the head 1 and the liquid ejecting device are increased in size. Further, as shown in FIG. 9, in the case where the projected portion 11 is formed from the same plane as the outer wall surface of the cover member 6 and impact or vibrations are applied to the cover member 6 due to the fall, the impact or vibrations to the cover member 6 may be directly operated to the projected portion 11. As a consequence, force applied to the projected portion 11 is increased and the projected portion 11 may deform.

Figure 10:
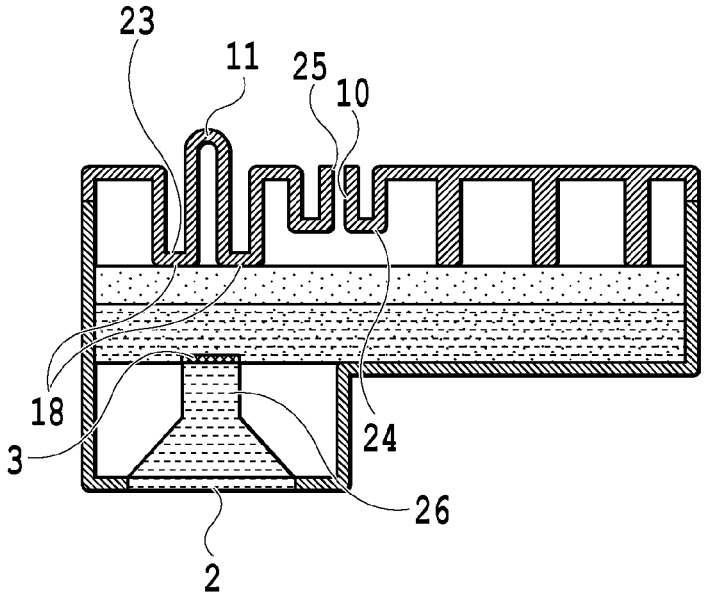
FIG. 10 is a cross-sectional view showing a modified example of the head in FIG. 5.

On the other hand, FIG. 10 shows a modified example of the head 1 shown in FIG. 5. The concave portion 23 is formed in an outer circumference of the projected portion 11 and the flow passage 26 that supplies the liquid to the liquid ejecting unit 2 from the liquid containing unit 20 is formed at a position facing the concave portion 23 in the head 1 shown in FIG. 10. Therefore, the filter 3 is formed at the position facing the concave portion 23. Further, the projected portion 11 is formed so as to project in a direction (direction towards the flow passage connecting member 13) to the outside of the liquid containing unit from the bottom surface 18 of the concave portion 23. Thus, the projected portion 11 extends from a position adjacent to the holding member 5 rather than the top surface of the outer wall surface of the cover member 6 in the direction to the outside of the liquid containing unit. As a consequence, the head 1 and the liquid ejecting device can be downsized.

In order to efficiently supply the liquid held in the holding member 5 to the liquid ejecting unit 2, it is required that the holding member 5 is pressed to the filter 3 arranged at a position adjacent to the liquid ejecting unit 2. In the head shown in FIG. 10, the concave portion 23 formed in the outer circumference of the projected portion 11 is formed at a position that comes into contact with the holding member 5. As a consequence, in the case where the cover member 6 is attached to the case 4, the holding member 5 is pressed in the direction towards the filter 3 with the concave portion 23. Therefore, just below the projected portion 11 and the concave portion 23, it is not necessary to provide the rib in the case where the holding member 5 is pressed in the direction to the filter 3, and the projected portion 11 and the concave portion 23 can function as the rib. Therefore, the configuration of the head 1 is simple and manufacturing costs of the head 1 can be reduced.

In the case where the head 1 includes a plurality of filters 3, preferably, the bottom surfaces 18 of the concave portion 23 in the outer circumference of the two projected portions 11 are just above the filters 3. In the case where the number of filters 3 is over two and the number of filters 3 is larger than the number of the projected portions 11, the holding member 5 may be pressed by only the pressing rib 8 for a portion where the holding member 5 cannot be pressed by the bottom surface 18 of the concave portion 23.

Further, in the case where one filter 3 is arranged in the head 1 and the number of the filter 3 is smaller than the number of the projected portions 11, preferably, the filter 3 is arranged as follows. That is, preferably, two projected portions 11 are arranged on the straight line along a scanning direction of the carriage 17, and the filter 3 is arranged at a position (e.g., a just-below position) corresponding to a line perpendicular to a line connecting the two projected portions 11. That is, in the case of forming a larger number of the concave portions 23 than the filters 3 on the flow passage 26 towards the liquid ejecting unit 2 in the liquid containing unit 20 of the head 1, a plurality of the concave portions 23 is arranged on a straight line along a direction in which the carriage 17 reciprocates. At this time, preferably, the filter is arranged at a position corresponding to a line perpendicular to a line connecting a plurality of the concave portions 23.

Here, the filter 3 is formed at a position just below a line perpendicular to the line connecting a plurality of the concave portions 23. With the structure, it is possible to press the holding members 5 in a direction to the filter 3 respectively at positions for sandwiching the filter 3 by the bottom portion 18 of the concave portion 23 around the two projected portions 11. Thus, the holding member 5 is hard to incline to the filter 3. As a consequence, the holding member 5 is more reliably made to come into contact with the filter 3. In the case where the projected portion 11 is just on the filter 3, preferably, the bottom portion 18 of the projected portion 11 is made as high as the bottom surface of the rib 8 or is located at a position for pressing the holding member 5 deeper than the rib 8.

Preferably, on the cover member 6, the concave portion 23 in the outer circumference of the position where the projected portion 11 is formed and the concave portion 24 in the outer circumference of the position where the liquid supply unit 10 is formed are independently formed. In a form shown in FIG. 10, the concave portion (second concave portion) 24 projected in a direction to the inside of the liquid containing unit 20 in the head 1 is formed in the outer circumference of the liquid supply unit 10. Inside the concave portion 24, the liquid supply unit 10 is formed, projected to the outside of the head 1 from the bottom surface thereof. The concave portion (first concave portion) 23 and the concave portion 24 are independently formed.

Figure 11A:
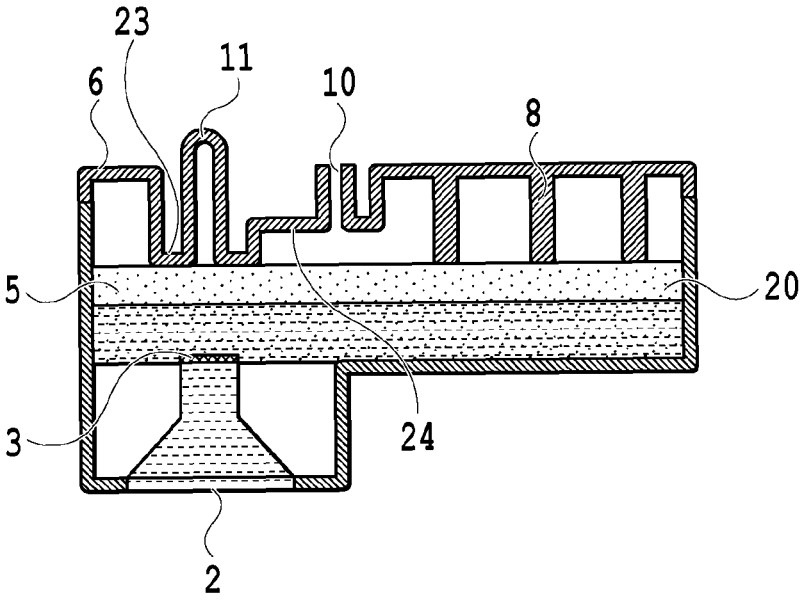
FIG. 11A is a cross-sectional view showing the head in FIG. 9.
Figure 11B:
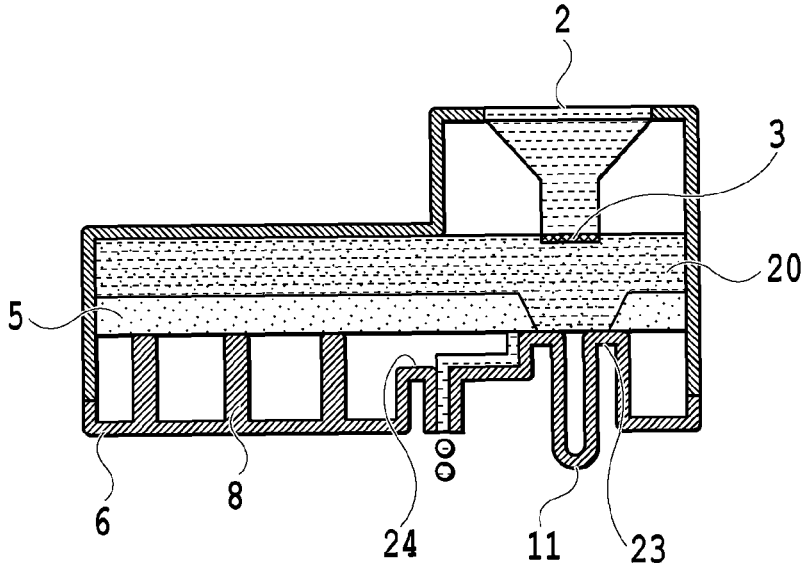
FIG. 11B is a diagram showing a state in which the head in FIG. 11A is arranged in an upside-down posture in the vertical direction.

FIG. 11A shows a cross-sectional view of the head in the case where the concave portion 23 and the concave portion 24 are not independently but continuously formed. FIG. 11A shows a state in which the head is arranged in a posture in which the head is mounted on the carriage of the liquid ejecting device. Further, FIG. 11B shows a state in which the head in FIG. 11A is arranged in a posture upside down. The liquid in the holding member 5 sometimes moves in the holding member 5 due to the change in air pressure, temperature, and humidity. In this case, the liquid may move to the front surface of the holding member 5 on the side of the cover member 6.

The projected portion 11 and the rib 8 are directly touched to the front surface of the holding member 5 on the side of the cover member 6. Therefore, in the case where the head 1 takes a posture in which the cover member 6 is located downward in the gravity direction, the liquid may move from the holding member 5 through the bottom surface 18 of the concave portion 23 and the concave portion 24. Therefore, depending on the shape of the head 1, as shown in FIG. 11B, the liquid stored inside the liquid containing unit 20 may leak to the outside via the liquid supply unit 10. In the material flow, the flow passage connecting member 13 is not connected to the liquid supply unit 10, and the liquid supply unit 10 is released to the air. Therefore, as shown in FIG. 11B, in the case where the wall surface in contact with the holding member 5 is directly connected to the outside, the liquid held in the holding member 5 may leak to the outside.

Figure 12:
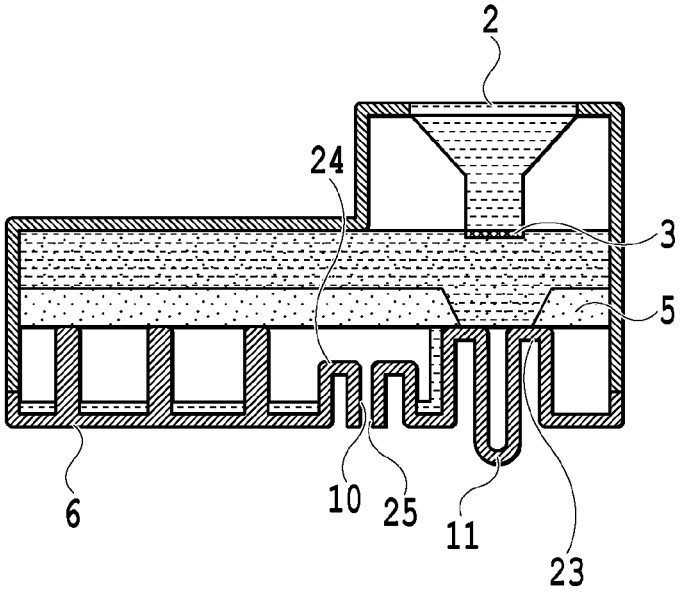
FIG. 12 is a cross-sectional view showing the head in FIG. 10.

On the other hand, the case is considered where the concave portion 23 formed in the outer circumference of the projected portion 11 and the concave portion 24 formed in the outer circumference of the liquid supply unit 10 are independently formed. FIG. 12 shows a cross-sectional view of the head 1 in a posture upside down. In the head 1 shown in FIG. 12, the top surface of the cover member 6 projected in the direction to the holding member 5 at the concave portion 23 is once returned to a same position as that on the surface arranged at the outermost and highest position, and the concave portion 24 that is concave in the direction from the position again to the holding member 5 is formed. As mentioned above, in the head 1, the forming surface of the cover member 6 is bent and formed. Therefore, as shown in FIG. 12, in the case where the head 1 takes a posture upside down, the liquid reaches the outermost position of the cover member 6 through the wall surface from the concave portion 23.

However, the liquid having reached the outer surface of the cover member 6 cannot flow to the outside via the liquid supply unit 10 in the case where the liquid does not reach a water level over the concave portion 24. Therefore, with the shape of the cover member 6 in the head 1, the leakage of the liquid to the outside via the liquid supply unit 10 is hard to occur. With the above-structured head 1, in the case where the liquid moves, as shown in FIG. 12, the supply port 25 of the opened liquid supply unit 10 is located further upward in the gravity direction than the position of the liquid. Therefore, the liquid is hard to drop from the opening of the supply port 25, which makes it possible to prevent the head 1 from getting dirty by the liquid in the material flow.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-214300 filed Oct. 30, 2015, which is hereby incorporated by reference wherein in its entirety.

What is claimed is:

1. A liquid ejecting device comprising:

a liquid container that can store liquid thereinside;

a head that is provided on a carriage and includes a liquid containing unit capable of storing liquid thereinside, and a liquid ejecting unit ejecting liquid; and a flexible member that supplies the liquid stored in the liquid container to the liquid containing unit, the flexible member having a flow passage connecting member, the flow passage connecting member having an inserting port and a flow-passage-connecting-member flow passage, wherein a concave portion that is concave in a direction to an inside of the liquid containing unit is formed on an outer wall surface of the liquid containing unit, and a projected portion that is projected in a direction to an outside of the liquid containing unit from a bottom surface of the concave portion and is inserted to the inserting port is formed inside the concave portion, and, inside the projected portion, there is no liquid flow path from the flow passage connecting member to the liquid container.

2. The liquid ejecting device according to claim 1, wherein the liquid containing unit has a case and a cover member, and the outer wall surface of the liquid containing unit on which the concave portion is formed is an outer wall surface of the cover member.

3. The liquid ejecting device according to claim 1, wherein the projected portion is not projected from a top surface of the outer wall surface of the liquid containing unit.

4. The liquid ejecting device according to claim 1, wherein the projected portion is projected from a top surface of the outer wall surface of the liquid containing unit.

5. The liquid ejecting device according to claim 4, wherein the projected portion has a height projected from the top surface of the outer wall surface of the liquid containing unit, the height being 20% or more and 70% or less of a height of the projected portion in the concave portion.

6. The liquid ejecting device according to claim 4, wherein the projected portion has a height projected from the top surface of the outer wall surface of the liquid containing unit, the height being 30% or more and 50% or less of a height of the projected portion in the concave portion.

7. The liquid ejecting device according to claim 1, wherein a holding member that can hold liquid is enclosed inside the liquid containing unit, and the bottom surface of the concave portion presses the holding member.

8. The liquid ejecting device according to claim 1, wherein, in a case where the concave portion is a first concave portion and a concave portion different from the first concave portion and arranged with a liquid supply unit from which the liquid is supplied to the liquid containing unit is a second concave portion, the first concave portion and the second concave portion are formed independently from each other.

9. The liquid ejecting device according to claim 1, wherein a holding member that can hold liquid is enclosed inside the liquid containing unit, a liquid flow passage that supplies the liquid to the liquid ejecting unit is formed in the liquid containing unit, a filter which is different from the holding member is arranged in the liquid flow passage, and the filter is located just below the concave portion in which the projected portion is formed and is located downward in a gravity direction.

10. The liquid ejecting device according to claim 9, wherein the carriage is configured capable of reciprocating, the liquid containing unit has a plurality of concave portions in which the projected portions are formed, a number of the concave portions being larger than a number of the filters, the plurality of concave portions is arranged on a straight line along a direction in which the carriage reciprocate, and the filter is arranged at a position corresponding to a line perpendicular to a line connecting the plurality of concave portions.

11. The liquid ejecting device according to claim 1, wherein a second concave portion different from the concave portion is provided on the outer wall surface of the liquid containing unit, a liquid supply unit is projected in a direction from a bottom surface of the second concave portion to an outside of the liquid containing unit, the flow-passage-connecting-member flow passage is inserted into the liquid supply unit, and, in the interior of the liquid supply unit, there is formed a flow path for liquid from the flow passage connecting member to the liquid container.

12. A head including a liquid containing unit that can store liquid thereinside and a liquid ejecting unit that ejects liquid, wherein a concave portion that is concave in a direction to an inside of the liquid containing unit is formed on an outer wall surface of the liquid containing unit, a projected portion that is projected in a direction to an outside of the liquid containing unit from a bottom surface of the concave portion is formed inside the concave portion and, inside the projected portion, there is no liquid flow path from the flow passage connecting member to the liquid container.

13. The head according to claim 12, wherein the liquid containing unit has a case and a cover member, and the outer wall surface of the liquid containing unit on which the concave portion is formed is an outer wall surface of the cover member.

14. The head according to claim 12, wherein the projected portion is not projected from a top surface of the outer wall surface of the liquid containing unit.

15. The head according to claim 12, wherein the projected portion is projected from a top surface of the outer wall surface of the liquid containing unit.

16. The head according to claim 15, wherein the projected portion has a height projected from the top surface of the outer wall surface of the liquid containing unit, the height being 20% or more and 70% or less of a height of the projected portion in the concave portion.

17. The head according to claim 15, wherein the projected portion has a height projected from the top surface of the outer wall surface of the liquid containing unit, the height being 30% or more and 50% or less of a height of the projected portion in the concave portion.

18. The head according to claim 12, wherein a holding member that can hold liquid is enclosed inside the liquid containing unit, and the bottom surface of the concave portion presses the holding member.

19. The head according to claim 12, wherein, in a case where the concave portion is a first concave portion and a concave portion different from the first concave portion and arranged with a liquid supply unit from which the liquid is supplied to the liquid containing unit is a second concave portion, the first concave portion and the second concave portion are formed independently from each other.

20. The head according to claim 12, wherein a holding member that can hold liquid is enclosed inside the liquid containing unit, a liquid flow passage that supplies the liquid to the liquid ejecting unit is formed in the liquid containing unit, a filter which is different from the holding member is arranged in the liquid flow passage, and the filter is located just below the concave portion in which the projected portion is formed and is located downward in a gravity direction.

* * * * *